US006007067A

United States Patent [19]

Hiorth

[11] Patent Number: 6,007,067

[45] Date of Patent: Dec. 28, 1999

[54] MULTI-OPERATIONAL EXPANSION GASKET

[76] Inventor: Espen Hiorth, Uglavn. 3, N-7024 Trondheim, Norway

[21] Appl. No.: 08/704,614

[22] PCT Filed: Mar. 21, 1995

[86] PCT No.: PCT/NO95/00057

§ 371 Date: Nov. 5, 1996

§ 102(e) Date: Nov. 5, 1996

[87] PCT Pub. No.: WO95/25876

PCT Pub. Date: Sep. 28, 1995

[30] Foreign Application Priority Data

Mar. 21, 1994 [NO] Norway ..... 941001

[51] Int. Cl.[6] ..... F16J 15/46

[52] U.S. Cl. ..... 277/34; 166/187

[58] Field of Search ..... 277/34, 34.6; 166/187; 138/129, 130

[56] References Cited

U.S. PATENT DOCUMENTS

| | | | |
|---|---|---|---|
| 2,643,722 | 6/1953 | Lynes et al. | 277/34.6 |
| 2,872,230 | 2/1959 | Desbrandes | 166/187 |
| 3,028,915 | 4/1962 | Jennings | 166/187 |
| 3,035,639 | 5/1962 | Brown et al. | 166/187 |
| 3,905,399 | 9/1975 | Dunnet | 138/129 |
| 4,614,346 | 9/1986 | Ito | 166/187 |
| 5,205,567 | 4/1993 | Quinlan | 277/34 |
| 5,236,201 | 8/1993 | Vance, Sr. et al. | 277/34 |
| 5,327,962 | 7/1994 | Head | 277/34 |
| 5,327,963 | 7/1994 | Vance, Sr. et al. | 277/34 |
| 5,340,626 | 8/1994 | Head | 277/34 |

*Primary Examiner*—Scott Cummings
*Attorney, Agent, or Firm*—Henderson & Sturm

[57] ABSTRACT

A multi-operational inflatable packer, particularly for use in oil and gas wells, comprises an outer rubber layer (5), at least two cord layers (6, 7) internal to the outer rubber layer (5), and an inner rubber layer (8); the cord layers comprise yarn of aramide fibers. The cord layers are arranged as one inner and one outer cord layer (6, 7), which are not embedded in rubber. The inner cord layer (7) comprises a thin yarn, and the outer cord layer (6) comprises a thicker yarn. Inner and outer cord layers (6, 7) are at the end of the packer anchored by a pressure sleeve (3). A packer ring of high tensile steel is situated within the pressure sleeve in direction against the packer (1), preferably having a yield strength above 700 MPa.

19 Claims, 2 Drawing Sheets

MULTI-OPERATIONAL EXPANSION GASKET

Figure 1:
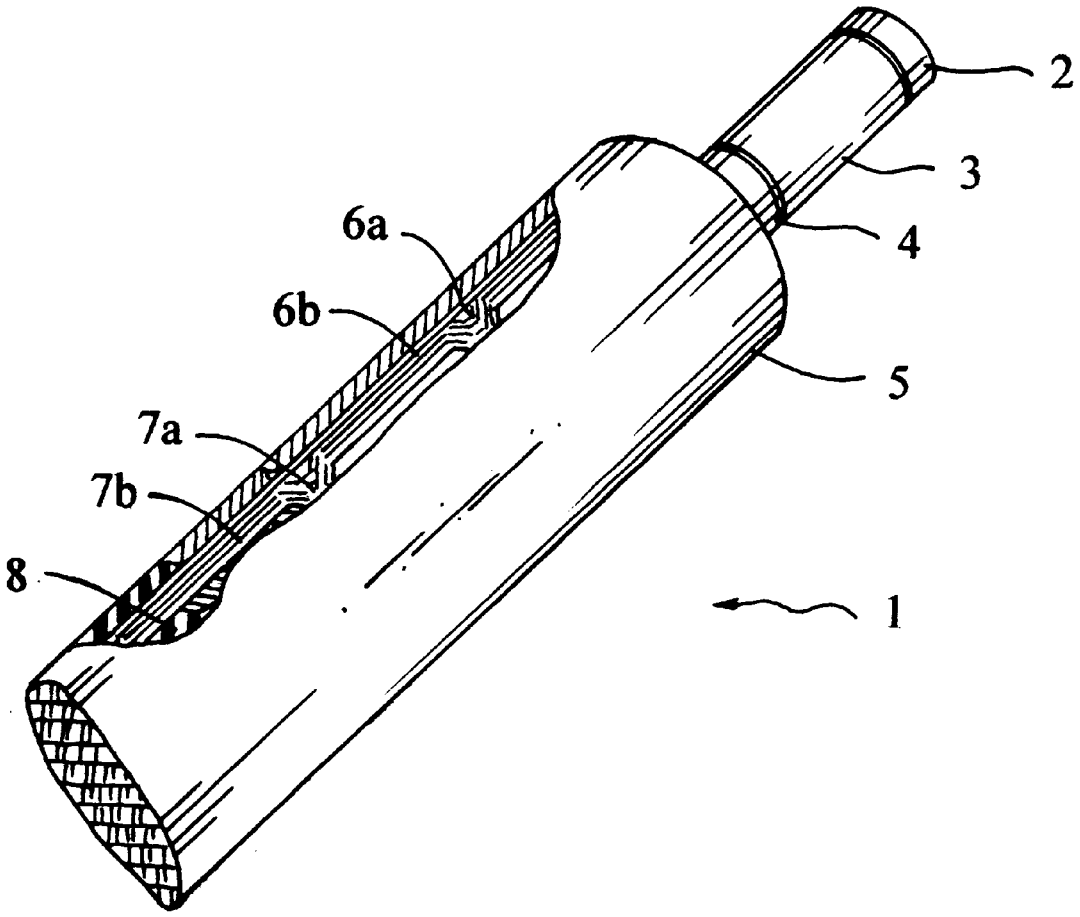

Present invention concerns a multi-operational inflatable packer, particularly for use in oil and gas wells, as stated in the introductory part of claim 1.

At intervention in e.g. oil and gas wells where different zones should be processed, tested, etc., inflatable packers are often used. This is due to the fact that it does not exist multi-operational packers that can be driven through small tube diameters, as, e.g., production pipes, and expanded to a significantly larger diameter by a high pressure.

The development within drilling and production technology tends towards long deviation and horizontal production zones having single bore completion. Long production zones will increase the need for multi-operational packers, for use in connection to selective testing, simulation, plugging, etc., of the different zones. Also, at single bore completion there is a need for highly expansion packers. A small diameter for running in and out provides for a number of advantages, especially at run-in, due to minor flow resistance over the packer. More operations may thus be run by light intervention equipment, as wire line or coiled tube instead of snubbing and drill stem.

In principle, an inflatable packer is constructed of three independent layers. These layers comprise first the inner rubber that should inhibit puncture and leakage of the fluid medium used for inflation. Furthermore, there is reinforcement layer that should absorb the forces from the inner over-pressure and optionally transfer axial and torsion forces from the equipment onto which the packer is mounted, to the bore wall. Additionally, there is an outer rubber that should protect the reinforcement layer from outer influence at running in and out, and during inflation against the bore wall to transfer the supplied forces.

Preferably there has been developed steel reinforced inflatable packers that meet the requirements for expansion and pressure. However, these are not multi-operational, as the steel reinforcement becomes permanently deformed at first expansion.

From GB 2 116 609 is known an inflatable packer comprising a plurality of layers of aramide fibres, in addition to rubber layers. The aramide fibres are located in rubber, one inner and one outer layer, where the strands in each layer are parallel, making an angle with the longitudinal axis of the packer; the next layer is located correspondingly, but with an opposite angle. The yarn are surface treated in order to achieve maximum attachment to the rubber in which they are embedded. At expansion, the distance between the yarn in each layer will increase, as will the angle between the layers. This will bring a very high stress to the rubber around the yarn so that local attachment rupture arises between yarn and rubber. Where attachment rupture arises, there will be a great danger for puncture, by the inner rubber being forced out between the yarn. By a packer of this kind, it will not be possible to expand to more than twice the diameter.

It has also shown that parallel winding yield too little stability in tangential direction. This may lead to local displacement of the yarn, point by point, and by that, a danger for puncture of the inner rubber.

The problem with the inner fibre layer puncture the inner layer of rubber is attempted to be remedied by winding an inner layer of fibres in a crosswise pattern. This has the disadvantage that at expansion, shear stress will arise, which can destroy the packer, especially in the area between the fitting and full expanded diameter.

The actual fitting of the inflatable packer does also represent a limitation for the expansion degree. The inflatable packer known from GB 2 116 609 has a fitting comprising a pressure sleeve, which do not have sufficient strength against deformation at great expansion and high pressure.

It is therefore an object for present invention to provide a multi-operational inflatable packer having a large degree of expansion, in the area two to three times the nominal diameter.

The object of the invention is achieved with a device having features as stated in the characterizing part of claim 1.

Further features are clear from the independent claims.

In the following, the invention will be closer described by means of an example of an embodiment and with reference to the enclosed drawings, where FIG. 1 disclose a partly sectional view of an inflatable packer according to present invention, and FIG. 2 discloses a section through the fitting of the inflatable packer from FIG. 1.

In FIG. 1 is disclosed an inflatable packer, generally denoted 1. The inflatable packer 1 is attached to a tube 2 by a pressure sleeve 3 and a high tensile ring 4. In FIG. 1 is shown an outer rubber layer 5, an outer cord layer 6 of aramide yarn having a diameter in the range of about 0.8 to about 1.3 mm, an inner cord layer 7 of aramide yarn having a diameter in the range of about 1.4 to about 2.0 mm, and finally an inner rubber layer 8.

At expansion of the packer, the inner and outer rubber will be exposed to large elastical stretches in tangential direction, and compression in radial and axial directions. The degree of compression in axial direction will be dependent upon the angle of the cord, with a degree of compression approximately zero at axial cord, and increasing with increasing cord angle. When the packer expands, the cord angle will increase, and expansion will stop upon reaching a blocking angle, which theoretically is at 54.7°. In test is found that the cord angle after expansion should be in the area of 30–36°. The laying angle will thus be the final angle divided by the increase in diameter, and for expansion three times the diameter the laying angle will be 8–12°.

The inner cord layer 7 comprises actually two layers 7*a*, 7*b*, being winded in a crosswise manner. This means that the layers 7*a*, 7*b* are alternating below and above each other, and are winded with one yarn. Thus the surface will have a pattern of triangles, where each triangle comprises yarn being winded opposite of the yarn in its adjacent triangles. The distance between each crosswise bonding should be relatively short (5–7 cm). The number of crosswise bondings is determined by the number of winding entries, that is, how many places on the end periphery the winding starts.

The inner cord layers 7*a*, 7*b* should hinder puncture of the inner rubber 8. The inner rubber layer 8 is exposed to puncture by the rubber cuts into the inner cord layer 7 at expansion. Preferably the inner rubber 8 should in expanded condition be thicker than the distance between the yarn in the cord layer 7. Furthermore, it is an advantage, especially in view of the packer should be multi-operational, that the inner rubber is reinforced, e.g., with short aramide fibres in order to avoid penetration of the cord 7. This should however not affect the rubber so that the elasticity becomes too low, as this again will lead to reduced puncture resistance.

Preferably, also the angle of the inner cord layers 7*a*, 7*b* are in the same range as the outer cord layers 6, that is 8–12°.

Also the outer cord layer 6 can comprise a plurality of layers, preferably being winded in parallel with opposite angles.

Figure 2:
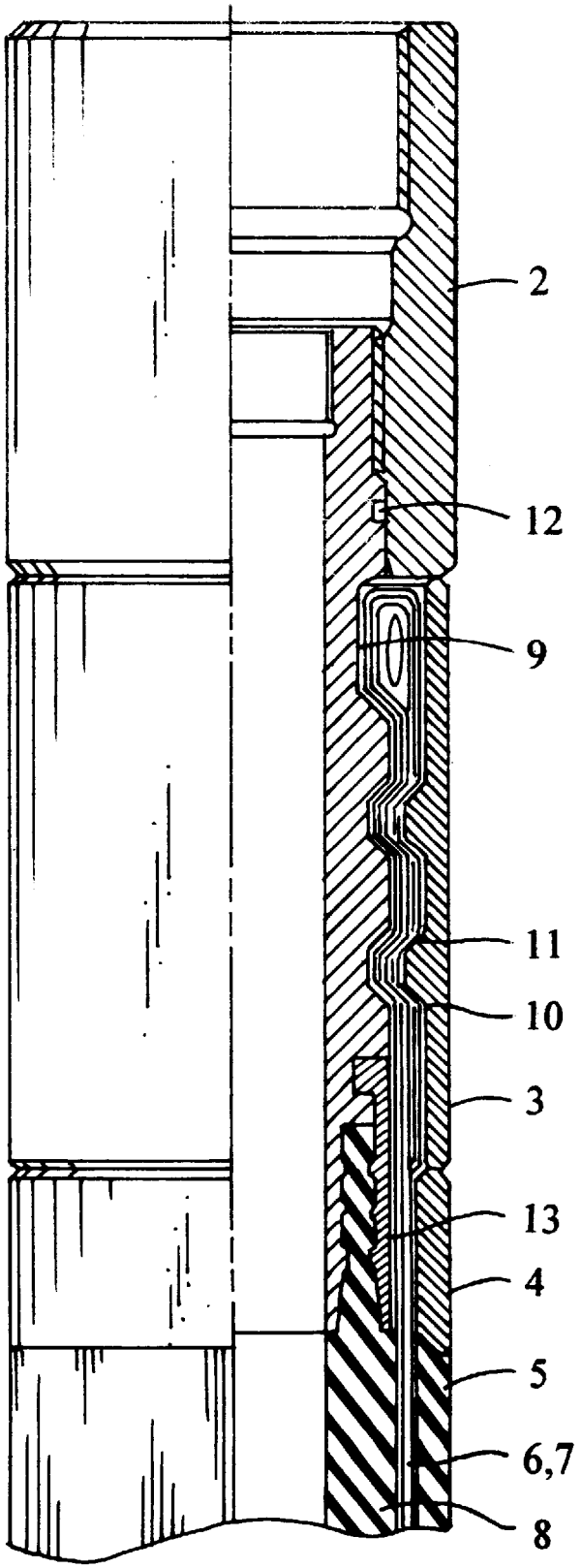

Referring now to FIG. 2, a section of the fitting for an inflatable packer according to present invention is shown. A connector 2 is connected to an inner sleeve 9 fastening the cord yarn. Between the connector 2 and the inner sleeve 9 is situated a stuffing box 12 as end fastening. In addition, a pressure sleeve 3 locking the cord to the inner sleeve 9 by means of grooves and ribs 10 in the pressures sleeve 3, which fit with grooves and ribs 10 in the inner sleeve 9. The inner rubber 8 is locked to the inner sleeve by means of a small pressure sleeve 13. A locker ring 4 for the cord is situated within the pressure sleeve 3 in direction against the inflatable packer. The locker ring 4 is a high tensile steel ring that shall inhibit expansion of the steel end of the fitting. The locker ring 4 is preferably made by a material that has a yield strength above 700 MPa.

I claim:

1. Inflatable packer, particularly for use in oil and gas wells, comprising an outer rubber layer, and at least two cord layers internal to an outer rubber layer, and an inner rubber layer, wherein the at least two cord layers comprise yarn of aramide fibres, and are winded from one yarn each, and wherein an inner cord layer comprises a yarn having a diameter in the range of about 0.8 to about 1.3 mm and an outer cord layer comprises a yarn having a diameter in the range of about 1.4 to about 2.0 mm and wherein at least one member selected from the group consisting of the inner cord layer and the outer cord layer comprises yarn that are winded in an angle to the longitudinal axis of the inflatable packer, in the range of about 8–12°, and wherein the inner cord layer is winded in a crosswise manner, and comprises two layers that are winded in a crosswise manner with one and one yarn, so as to provide a surface with a pattern of triangles, wherein each of said triangles comprise yarns that are winded opposite of yarns of its adjoining triangles.

2. The inflatable packer according to claim 1, wherein the distance between each crosswise winding is in the area of about 5–7 cm.

3. The inflatable packer according to claim 1, wherein the outer cord layer is winded in parallel.

4. The inflatable packer according to claim 1, wherein the outer cord layer comprises two layers winded in parallel, and winded in opposite angles.

5. The inflatable packer according to claim 1, wherein the inner and outer cord layers at the end of the packer are anchored by a pressure sleeve comprising a packer ring of high tensile steel situated within the pressure sleeve in direction against the packer.

6. The inflatable packer according to claim 1, wherein the diameter of said yarn of the inner core layer comprises about 1.1 mm.

7. The inflatable packer according to claim 6, wherein the diameter of said yarn of said outer cord layer comprises about 1.7 mm.

8. The inflatable packer according to claim 7, wherein said angle is about 10°.

9. The inflatable packer according to claim 2, wherein the outer cord layer is winded in parallel.

10. The inflatable packer according to claim 9, wherein the outer cord layer comprises two layers winded in parallel, and winded in opposite angles.

11. The inflatable packer according to claim 2, wherein the outer cord layer comprises two layers winded in parallel, and winded in opposite angles.

12. The inflatable packer according to claim 3, wherein the outer cord layer comprises two layers winded in parallel, and winded in opposite angles.

13. The inflatable packer according to claim 2, wherein the inner and outer cord layers at the end of the packer are anchored by a pressure sleeve comprising a packer ring of high tensile steel situated within the pressure sleeve in direction against the packer.

14. The inflatable packer according to claim 3, wherein the inner and outer cord layers at the end of the packer are anchored by a pressure sleeve comprising a packer ring of high tensile steel situated within the pressure sleeve indirection against the packer.

15. The inflatable packer according to claim 4, wherein the inner and outer cord layers at the end of the packer are anchored by a pressure sleeve comprising a packer ring of high tensile steel situated within the pressure sleeve in direction against the packer.

16. The inflatable packer according to claim 5, wherein said high tensile steel comprises a yield strength above about 700 Mpa.

17. The inflatable packer according to claim 13, wherein said high tensile steel comprises a yield strength above about 700 Mpa.

18. The inflatable packer according to claim 14, wherein said high tensile steel comprises a yield strength above about 700 Mpa.

19. The inflatable packer according to claim 15, wherein said high tensile steel comprises a yield strength above about 700 Mpa.

* * * * *